US010317061B2

(12) United States Patent
Klafta et al.

(10) Patent No.: US 10,317,061 B2
(45) Date of Patent: Jun. 11, 2019

(54) ASSEMBLY OF A SEMI-CONDUCTOR LAMP FROM SEPARATELY PRODUCED COMPONENTS

(71) Applicant: LEDVANCE GmbH, Garching bei Munchen (DE)

(72) Inventors: Thomas Klafta, Maxuette-Haidhof (DE); Hubertus Breier, Dettingen-Gerstetten (DE); Michael Rosenauer, Regensburg (DE); Marianne Auernhammer, Monheim (DE)

(73) Assignee: LEDVANCE GMBH, Garching Bei München (DE)

( * ) Notice: Subject to any disclaimer, the term of this patent is extended or adjusted under 35 U.S.C. 154(b) by 0 days.

(21) Appl. No.: 16/186,016

(22) Filed: Nov. 9, 2018

(65) Prior Publication Data

US 2019/0093869 A1 Mar. 28, 2019

Related U.S. Application Data

(63) Continuation of application No. 14/914,288, filed as application No. PCT/EP2014/067913 on Aug. 22, 2014, now Pat. No. 10,125,960.

(30) Foreign Application Priority Data

Aug. 26, 2013 (DE) ..... 10 2013 216 961

(51) Int. Cl.
*F21V 23/00* (2015.01)
*F21V 31/00* (2006.01)
(Continued)

(52) U.S. Cl.
CPC ..... *F21V 23/006* (2013.01); *F21K 9/23* (2016.08); *F21K 9/238* (2016.08); *F21K 9/90* (2013.01);
(Continued)

(58) Field of Classification Search
CPC .... F21V 23/006; F21V 29/771; F21V 31/005; F21K 9/23; F21K 9/238; F21K 9/90; F21Y 2115/10
(Continued)

(56) References Cited

U.S. PATENT DOCUMENTS 7,993,025 B2 8/2011 Chiu
2008/0043483 A1 2/2008 Effner et al.
(Continued)

FOREIGN PATENT DOCUMENTS

CN 1866563 A 11/2006
CN 102648374 A 8/2012
(Continued)

*Primary Examiner* — Laura K Tso
(74) *Attorney, Agent, or Firm* — Hayes Soloway PC

(57) ABSTRACT

Various embodiments may relate to a semiconductor lamp having at least one semiconductor light source, including multiple separately produced components, wherein at least two of the components are connected to one another by means of joint extrusion coating. Various embodiments further relate to a method for producing a semiconductor lamp having at least one semiconductor light source. The method includes at least, inserting at least one open driver housing and a cover for the driver housing into an injection mold, and extrusion coating the components inserted into the mold using potting material so that these components are permanently connected to one another by the potting material.

20 Claims, 3 Drawing Sheets

(51) Int. Cl.

| | |
|---|---|
| ***F21K 9/238*** | (2016.01) |
| ***F21V 29/77*** | (2015.01) |
| ***F21K 9/23*** | (2016.01) |
| ***F21K 9/90*** | (2016.01) |
| *F21Y 115/10* | (2016.01) |

(52) U.S. Cl.
CPC ..... *F21V 29/777* (2015.01); *F21V 31/005* (2013.01); *F21Y 2115/10* (2016.08)

(58) Field of Classification Search
USPC ..... 362/249.01
See application file for complete search history.

(56) References Cited

U.S. PATENT DOCUMENTS

| | | | | |
|---|---|---|---|---|
| 2009/0303719 | A1 | 12/2009 | Ko | |
| 2010/0014304 | A1 | 1/2010 | Frey et al. | |
| 2011/0095690 | A1 | 4/2011 | Sagal | |
| 2011/0101861 | A1 | 5/2011 | Yoo | |
| 2012/0099326 | A1 | 4/2012 | Hammond et al. | |
| 2012/0262066 | A1 | 10/2012 | Bakk | |
| 2013/0003361 | A1* | 1/2013 | Igaki | F21V 29/004 362/184 |
| 2013/0114251 | A1 | 5/2013 | Duan | |
| 2013/0175570 | A1 | 7/2013 | Chin | |
| 2015/0362135 | A1* | 12/2015 | Sugiyama | G03B 21/204 362/84 |
| 2016/0077415 | A1* | 3/2016 | Motoya | G03B 21/204 353/84 |
| 2016/0091712 | A1* | 3/2016 | Egawa | G03B 21/204 353/31 |

FOREIGN PATENT DOCUMENTS

| | | | |
|---|---|---|---|
| DE | 102009056115 | A1 | 6/2011 |
| DE | 102012100838 | A1 | 5/2013 |
| EP | 2317206 | A1 | 5/2011 |
| EP | 2508796 | A2 | 10/2012 |
| TW | 201111700 | A1 | 4/2011 |
| TW | 201319456 | A | 5/2013 |
| WO | 2012164506 | A1 | 12/2012 |
| WO | 2013120736 | A1 | 8/2013 |

* cited by examiner

ASSEMBLY OF A SEMI-CONDUCTOR LAMP FROM SEPARATELY PRODUCED COMPONENTS

CROSS-REFERENCE TO RELATED APPLICATIONS

This patent application is a Continuation of U.S. patent application Ser. No. 14/914,288, filed on Feb. 25, 2016, and titled "Assembly of a Semi-Conductor Lamp from Separately Produced Components," which claims the benefit of and priority to PCT Application No. PCT/EP2014/067913, filed on Aug. 22, 2014, which claims the benefit of and priority to German Patent Application No. 10 2013 216 961.2, filed on Aug. 26, 2013. Each of these patent applications is herein incorporated by reference in its entirety.

TECHNICAL FIELD

Various embodiments relate to a semiconductor lamp having at least one semiconductor light source, including multiple separately produced components. Various embodiments furthermore relate to a method for producing a semiconductor lamp having at least one semiconductor light source. Various embodiments are usable, in particular, on retrofit lamps, for example, on lamps for PAR (parabolic aluminized reflector) headlights, in particular PAR 16, or on halogen lamp retrofit lamps of the type MR (multifaceted reflector), in particular MR 16.

BACKGROUND

An LED (light-emitting diode) lamp has heretofore been assembled in multiple work steps from multiple components in a complex manner in a manufacturing line or by hand. Due to the required fastenings of the individual components to one another (for example, by screwing, gluing, or latching), costly reworking and production downtimes occur again and again as a result of tolerances and manufacturing problems.

SUMMARY

Various embodiments provide an improved possibility for assembly of a semiconductor lamp, in particular, an LED lamp.

Various embodiments relate to a semiconductor lamp having at least one semiconductor light source, including at least two separately produced components, wherein at least two of the components are permanently connected to one another by means of joint extrusion coating or a joint extrusion coating material. The usage of extrusion coating has the advantage that more cost-effective components can be used, since tolerances can be embodied more coarsely. Because of this and by omitting manual assembly, reworking and production downtimes can be avoided to a significant extent, and the production costs can be reduced. In addition, fastening elements such as catches or screws on the individual components can be omitted.

The at least one semiconductor light source may include at least one light-emitting diode. If multiple light-emitting diodes are provided, they can illuminate in the same color or in different colors. A color can be monochromatic (for example, red, green, blue, etc.) or multi-chromatic (for example, white). The light emitted from the at least one light-emitting diode can also be infrared light (IR-LED) or ultraviolet light (UV-LED). Multiple light-emitting diodes can generate mixed light, for example, white mixed light. The at least one light-emitting diode can contain at least one wavelength-converting phosphor (conversion LED). The phosphor can alternatively or additionally be situated remotely from the light-emitting diode ("remote phosphor"). The at least one light-emitting diode can be provided in the form of at least one separately housed light-emitting diode or in the form of at least one LED chip.

Multiple LED chips can be mounted on a joint substrate ("sub-mount"). The at least one light-emitting diode can be equipped with at least one separate and/or joint optical system for beam guiding, for example, at least one Fresnel lens, collimator, etc. Alternatively, or additionally, to inorganic light-emitting diodes, for example, based on InGaN or AlInGaP, organic LEDs (OLEDs, for example, polymer OLEDs) are generally also usable. Alternatively, the at least one semiconductor light source may include, for example, at least one diode laser. A wavelength-converting phosphor can also be connected downstream of the at least one diode laser, for example, in a LARP ("laser activated remote phosphor") arrangement.

The semiconductor lamp may be, in particular, a replacement lamp or retrofit lamp for replacing conventional lamps, for example, for replacing an incandescent lamp, a halogen lamp, a gas discharge lamp, a gas discharge tube, a linear lamp, etc. The retrofit semiconductor lamp may, in particular, include a base which fits in conventional sockets for this purpose, for example, an Edison base, a bipin base (for example, of the GU type), or a bayonet base. The invention is particularly advantageously usable on halogen lamp retrofit lamps, in particular, for PAR headlights, for example, of the type PAR 16, or on halogen lamp retrofit lamps for the type MR, for example, MR 16 or MR 11.

It is a refinement that the semiconductor lamp includes at least two separately produced, functionally different components, wherein at least two of the functionally different components are permanently connected to one another by means of joint extrusion coating. "Functionally different components" may be understood in particular as components which exert a different function of the semiconductor lamp, for example, a cover or upper housing part of a driver housing, on the one hand, and a heat sink, on the other hand.

At least one of the components may have an undercut in relation to the joint extrusion coating to produce a formfitting connection via the joint extrusion coating or extrusion coating material.

The extrusion coating material preferably consists of plastic, for example, thermoplastic plastic such as PP, PA, PA, PBT, POM, PC, ABS, PPS, and/or PS.

It is an embodiment that the semiconductor lamp includes at least three separately produced, in particular, functionally different components, wherein at least three of the components are connected to one another by means of joint extrusion coating. The simultaneous extrusion coating of at least three components has the advantage that the savings in assembly expenditure are particularly high. In the conventional assembly between only two components at a time (for example, by latching, gluing, etc.), two work steps are necessary for this purpose. The more components are connected by means of joint extrusion coating, the greater the savings.

It is also an embodiment that the multiple components include at least two of the following components:

an open driver housing, a cover for the driver housing, a first heat sink, which can be placed on the cover, a substrate equipped with at least one semiconductor light source, a light-transmissive cover for the substrate, a second heat sink, which at least laterally covers the driver housing, and/or at least one rear terminal contact arranged on the rear of the driver housing, in particular a terminal pin, for the supply voltage.

Important parts of a semiconductor lamp can be connected by means of the joint extrusion coating by way of this embodiment.

It is a refinement that all separately produced or previously manufactured components are connected by means of the joint extrusion coating for the final assembly. In particular, no further component has to be subsequently attached to such a jointly extrusion-coated component composite any longer, for example, by latching, gluing, etc. The joint extrusion coating then corresponds to the last assembly or mounting step of the semiconductor lamp.

The open driver housing may be provided, in particular, for accommodating a driver. The driver housing may, in particular, be open on the front and may include on the rear at least one electrical terminal contact for connection to a conventional socket. The at least one electrical terminal contact may represent, for example, a part of a base or a base region. The base may be designed, for example, as an Edison base (for example, of the E type such as E14 or E27), as a plug or bipin base (for example, of the GU type such as GU5.3 or GU10), as a bayonet base (for example, of the type BC, B22, or B22d), or as a tube base (for example, of the type G5 or G13).

It is a further embodiment that the semiconductor lamp includes a driver for operating at least one semiconductor light source. The driver is used to convert electrical signals, which are received via the at least one electrical terminal contact (for example, a supply voltage, in particular, a network voltage), into electrical signals suitable for operating the at least one semiconductor light source. The driver may include a circuit board or printed circuit board, for example, on which one or more driver components are arranged, which can form driver electronics, for example.

The cover for the driver housing may also be referred to as the upper driver housing. It may, in particular, include at least one feedthrough, for example, a cable channel, for feeding through electrical lines from the driver to the at least one semiconductor light source. The cover may have a planar support surface, in particular, on its front side which faces away from the (lower) driver housing, for example, for the first heat sink (if present) or for the substrate.

The cover may be used, for example, for touch protection from electrical voltage and as a holder of the electrical driver housed in the driver housing. The feedthrough of the cover can additionally be used to guide and stabilize the electrical lines, for example, cables, for the electrical supply of the semiconductor light sources. Thus, the soldering of the substrate to the electrical lines can be simplified. Laser soldering can also be used. This substantially simplifies machine soldering of the substrate to the electrical lines.

The first heat sink, which may be placed on the cover, may be used, for example, to dissipate heat generated by the semiconductor light source(s) from the substrate, in particular, laterally outward. The heat sink may have a basic shape in the form of a ring disk for this purpose, the outer edge of which is preferably formed as a circumferential band perpendicular thereto. A hole in the heat sink (in particular, in the center thereof) may be used, for example, for feeding through a cable channel of the cover which protrudes forward.

The substrate which is equipped with the at least one semiconductor light source may be, for example, a circuit board (frequently also referred to as a "sub-mount"), which is equipped with the at least one semiconductor light source. The circuit board may include, for example, typical printed circuit board material as the base material, for example, FR4, may be formed as a metal core printed circuit board, or may include ceramic, for example, AlN, as the base material ("ceramic substrate"). The substrate may be formed, for example, in the form of a ring disk, wherein a central hole may be used, for example, to feed through the cable channel of the cover, which protrudes forward.

The light-transmissive cover for the substrate and therefore also the at least one semiconductor light source and optionally additional electrical or electronic components arranged on the substrate may include, for example, a transparent or opaque (translucent) protective cover and/or at least one optical element (for example, a reflector, a lens, a collimator, a screen, etc.).

The second heat sink may consist, for example, of metal, for example, aluminum. It encloses, in particular, the driver housing laterally and may have cooling ribs, which extend in the longitudinal direction, for example, and are arranged offset in the circumferential direction. The second heat sink may be connected to the first heat sink or may be spaced apart at a small distance, to enable improved heat dissipation from the first heat sink.

The first heat sink and/or the second heat sink may—if present—consist, for example, of metal, for example, aluminum, and/or copper. The heat sink may be provided, for example, by aluminum casting, as a deep-drawn part, or as an extruded profile. The use of the first heat sink and/or the second heat sink may be advantageous, in particular, in the case of higher-power semi conductor lamps.

The at least one terminal contact, which is arranged on the rear of the driver housing, in particular, protruding therefrom, for the supply voltage may be in particular a terminal pin or pin, for example, of a GU base.

The terminal contacts for the supply voltage on the one (rear) side and the light-transmissive cover, for example, lens, for the substrate on the other side, can be used, in particular, as fastening points in the tool or in the injection mold. This makes the handling and therefore the production easier.

It is a still further embodiment that the semiconductor lamp is a semiconductor lamp formed as dust-tight and/or water-tight by means of the joint extrusion coating. This increases the breadth of application in a particularly simple manner, because it is not linked to further expenditure. In particular, the semiconductor lamp is thus also particularly advantageously usable outside.

The joint extrusion coating has the further advantage that a touch safety in relation to electrical voltages is thus achievable in a simple manner.

It is an embodiment that the driver is an encapsulated ("potted") driver. This results in the advantage that the driver is enclosed using a protective encapsulation material before the joint extrusion coating. The driver can thus pass through an extrusion coating process after curing of the encapsulation material, without being damaged due to the high temperatures or pressures occurring therein. In addition, a particularly high level of touch safety in relation to electrical voltages is thus enabled. The encapsulation material may be a thermoplastic and/or thermosetting plastic or, for example, silicone.

In a conventional encapsulation of the driver, it is manually inserted into the (lower) driver housing and potted therein in the installed state using the encapsulation material. The encapsulation material may then be cured at a temperature of 80° C. for approximately half an hour, and at a room temperature of 25° C. for approximately eight hours.

It is also an embodiment that the driver is a pre-encapsulated ("pre-potted") driver. In this case, at least the driver may be previously encapsulated and cured (i.e., before a transfer into the line manufacturing including the joint extrusion coating). This enables line manufacturing, since the waiting time for curing during the line manufacturing can be omitted. Production of the semiconductor lamp may thus be simplified, because when introducing the components to be used in the casting mold during the line manufacturing, pouring of the encapsulation material into the driver housing and the curing of the encapsulation material and the driver do not have to be waited out. Rather, the components encapsulated using the encapsulation material can already be produced beforehand and then supplied on demand. The components which are jointly connected by the encapsulation material or "potting material" (i.e., at least the driver) additionally have a long durability due to the encapsulation and therefore are also storable for a long time.

It is a refinement that a driver housing can be omitted in the case of a pre-encapsulated driver. The external surface of the encapsulation material may then assume the function of the external surface of the driver housing, for example, for supporting a heat sink and/or a cover and for contacting the joint extrusion coating material.

When a pre-encapsulated driver is inserted into the housing, no functional impairments result in comparison to encapsulation by potting in the driver housing. For example, the thermal connection to the driver housing for pre-encapsulated drivers is comparable to drivers encapsulated in the driver housing.

Therefore, no temperature increases result on the driver during the operation of the semiconductor lamp. This method can thus also be used in semiconductor light sources having high powers.

At least the driver is inserted into a metal or plastic mold for the pre-encapsulation or pre-potting. However, still further components can also be inserted with the driver, for example, the cover for the driver housing, the first heat sink, and/or the terminal pins (see also further below). This is followed by filling of the mold with liquid encapsulation material and then curing, for example, in the furnace at 80° C. and 30 minutes or curing for eight hours at room temperature. The pre-encapsulation is carried out in a different line than the joint extrusion coating. The assembly of the semiconductor lamp can now also be practically automated expediently in the scope of line manufacturing. A waiting time for the curing would not arise during the line manufacturing, which also includes the joint extrusion coating.

For example, electrical lines which are connected to the driver, for example, wires or cables for electrical connection to the at least one semiconductor light source, a first heat sink, a substrate for supporting the at least one semiconductor light source, metal bolts or metal pins for pushing onto electrical terminal contacts, and/or the electrical terminal contacts, can also be encapsulated. This may simplify production, for example.

For example, a cover which is also pre-encapsulated can be used as a holder for the driver in the potting casting mold. The cover can furthermore be used for guiding and stabilizing the electrical lines, for example, cables for the operating voltage of the semiconductor light sources. Soldering to the substrate can thus also be simplified. Laser soldering may also be used for this purpose in particular. The machine soldering of the substrate to the electrical lines is, thus, also enabled.

It is a refinement that after the pre-encapsulation and before the joint extrusion coating, a step of electrically connecting the at least one electrical line between the driver and the at least one semiconductor light source is carried out, in particular, by connection to the substrate. The connection may be carried out, for example, by soldering, in particular, laser soldering.

Various embodiments also relate to a method for producing a semiconductor lamp having at least one semiconductor light source, wherein the method includes at least the following steps: inserting at least two separately produced components of the semiconductor lamp into an injection mold; and extrusion coating these components using potting material or injection molding material, so that these components are connected to one another by the potting material.

This method may be designed similarly to the semiconductor lamp and results in the same advantages.

It is an embodiment that the method includes at least the following steps: inserting at least one (frontally) open driver housing and a cover for the driver housing into an injection mold; and extrusion coating the components inserted into the mold using potting material, so that these components are connected to one another by the potting material. The connection of these two components by joint extrusion coating is particularly advantageous, since a leak-tight connection between them is thus achievable in a simple manner. This leak-tight connection in turn prevents penetration of moisture and/or dust, which could otherwise accumulate in the driver housing and could result in lasting corrosion, for example. Other types of connections such as latching or gluing, in contrast, have a much greater risk of undesired gap formation between the (lower or rear) driver housing and the cover (or front driver housing) covering this opening.

It is a still further embodiment that, during the step of insertion, at least one of the following components:

- a first heat sink, which can be placed on the cover
- a substrate equipped with at least one semiconductor light source,
- a light-transmissive cover for the substrate,
- a second heat sink, which at least laterally covers the driver housing, and/or
- at least one terminal contact arranged on the rear of the driver housing, in particular, a terminal pin, is also inserted into the injection mold, so that this at least one component is also permanently connected to the other components inserted into the injection mold by the potting material.

Furthermore, it is an embodiment that before the extrusion coating, a pre-encapsulated driver is inserted into the driver housing. The pre-encapsulated driver may therefore be enclosed by encapsulation material ("potting material") before the insertion. The pre-encapsulation ("pre-potting") results in the advantage that the electrical components and/or electronic components of the driver are protected from the high injection pressure and the high temperatures for the joint plastic injection.

It is also an embodiment that the following can also be pre-encapsulated ("pre-potted") with the driver: the cover for the driver housing, the first heat sink, and/or the terminal pins and also optionally at least one electrical line. This may have production advantages, for example, with respect to handling of electrical lines. The cover, the first heat sink, and/or the terminal pins may thus be encapsulated together with the driver and/or extrusion coated by the joint extrusion coating, and, in particular, with associated electrical lines.

The at least one pre-encapsulated component, in particular, the pre-encapsulated driver, can also be used as a skeleton/support framework. In addition, the at least one component can be electrically insulated by an electrically insulating encapsulation material which encloses it. A separate electrical insulation can be omitted.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which.

DETAILED DESCRIPTION

Figure 1:
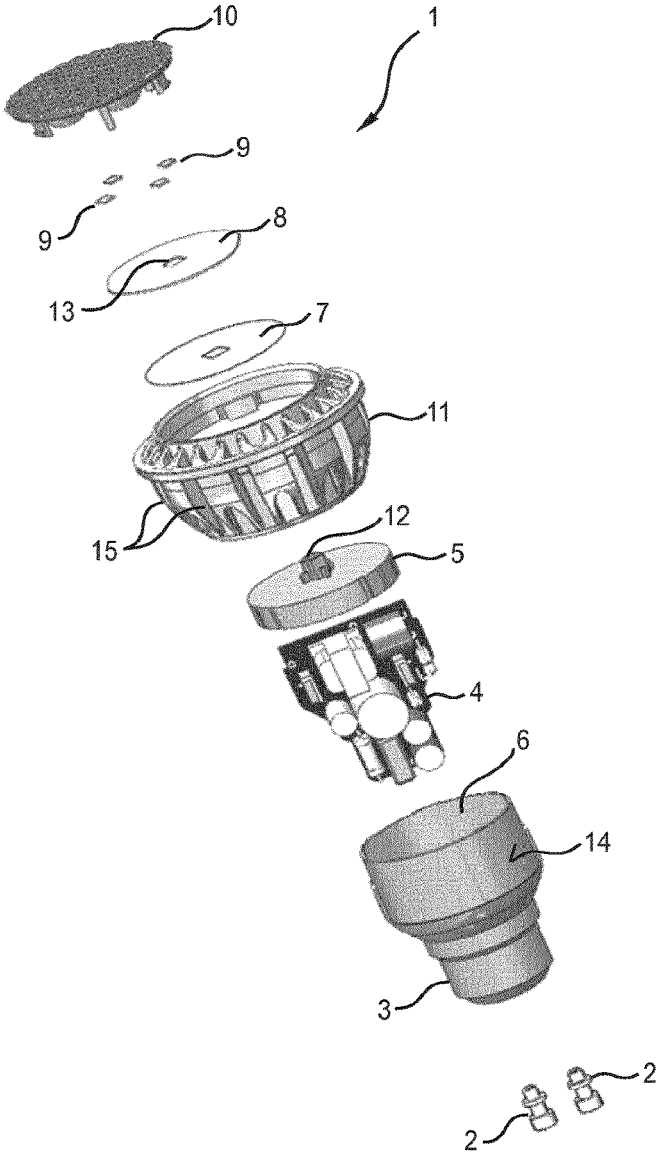
FIG. 1 shows an exploded illustration in a diagonal view of a semiconductor lamp according to a first embodiment.

FIG. 1 shows an exploded illustration in a diagonal view of a semiconductor lamp in the form of an LED lamp 1 according to a first embodiment. The LED lamp 1 has, in the sequence shown, from a rear end to a front end: two terminal contacts, which protrude in the rear direction, in the form of, for example, MR16-compatible terminal pins 2, a (lower) driver housing 3, which has a side 6 open to the front, a driver 4 to be inserted into the driver housing, a cover 5 for covering the open side 6 of the driver housing 3, an adhesive film 7 ("TIM film"), which is in the form of a ring disk, has good thermal conductivity, and is to be laid on the front side of the cover 5, a substrate 8, which is in the form of a ring disk and which is to be laid with its rear side on the adhesive film 7 and has multiple semiconductor light sources in the form of light-emitting diodes (LEDs) 9 on its front side, and a light-transmissive cover in the form of a lens 10. In addition, a laterally circumferential (second) heat sink 11 is provided.

The LED lamp 1 is designed here as a halogen lamp retrofit lamp, in particular, of the type MR16. The terminal pins 2 and the driver housing 3 therefore form a base of the GU type.

The driver 4 is not pre-encapsulated here, but rather is potted using encapsulation material (upper figure), if at all, in the driver housing 3, for example. The driver 4 is electrically connected to the terminal pins 2 in the assembled state and can be supplied with a supply voltage via these pins.

The cover 5 can also be referred to as the upper driver housing and is used for closing the open side 6 of the lower driver housing 3. The cover 5 has a central cable channel 12, which protrudes forward, and through which electrical lines (upper figure) for supplying the LEDs 9 are led from the driver 4 to the substrate 8.

The substrate 8 has a central opening 13 for feeding through the cable channel 12. The substrate 8 may be, for example, a ceramic substrate or a metal core printed circuit board.

The LEDs 9 are typically placed on the front side of the substrate 8 in a separate manufacturing process. The LEDs 9 are designed here as housed LEDs, for example, as LEDs which emit white light.

The laterally circumferential heat sink 11 is produced from aluminum, for example, and is provided to be laid on an exterior lateral surface 14 of the driver housing 3. At least one task thereof is to dissipate the heat generated inside the driver housing 3. The heat sink 11 has multiple cooling ribs 15 here, which are aligned in parallel to the longitudinal direction (vertically) and are equidistantly distributed in the circumferential direction.

Figure 2:
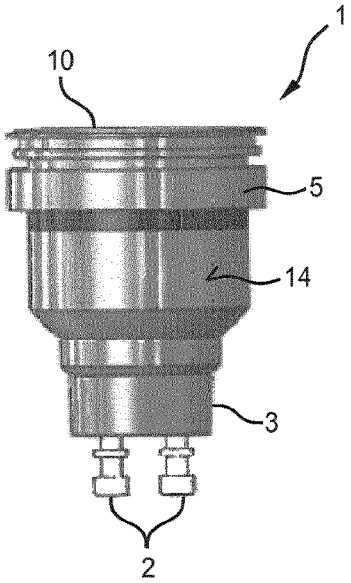
FIG. 2 shows the semiconductor lamp according to a first embodiment in a side view in a state assembled by joint extrusion coating.

The above components have been previously produced separately. They are functionally different. They are connected to one another by means of joint extrusion coating (after potting of the driver 4) for the final assembly of the LED lamp 1. The LED lamp 1 thus produced is shown—without the heat sink 11—in FIG. 2. It is water-tight and dust-tight and therefore suitable, in particular, for use outside.

Figure 3:
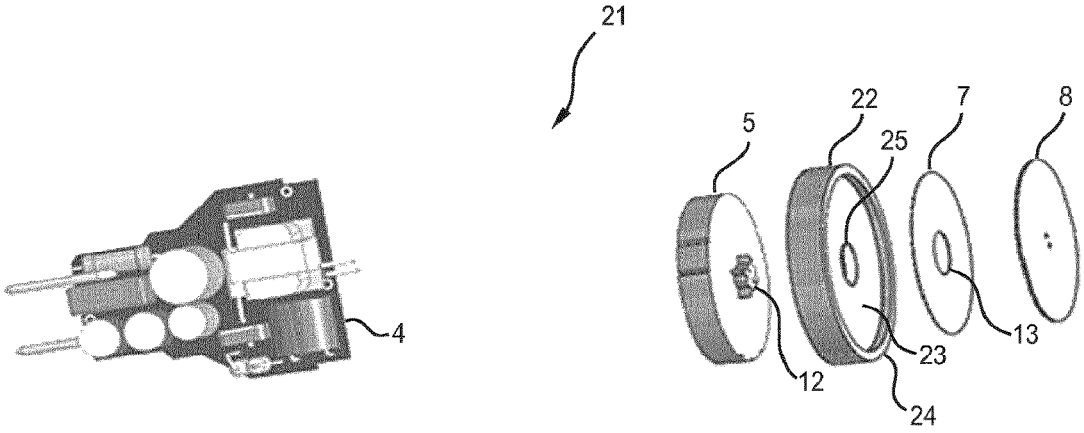
FIG. 3 shows a diagonal view in an exploded illustration of components, including a driver, of a semiconductor lamp according to a second embodiment, which components are provided for joint pre-encapsulation.

FIG. 3 shows multiple components of an LED lamp 21, which were pre-encapsulated together before the joint extrusion coating, namely the driver 4, the cover 5, a (first) heat sink 22, the adhesive film 7, and the substrate 8, which is equipped with the LEDs 9 (upper figure). Alternatively, the substrate 8 may not yet be equipped with the LEDs 9.

The heat sink 22, which consists, for example, of aluminum or copper, is used for dissipating heat from the substrate 8, which is in turn heated by the waste heat of the LEDs 9. For good heat transfer, the rear side of the substrate 8 rests via the adhesive film 7 on a front side of the heat sink 22, while the rear side of the heat sink 22 rests on the front side of the cover 5. The heat sink 22 has a basic shape 23 in the form of a ring disk, the outer edge 24 of which is formed as a circumferential band perpendicular thereto. A hole 25 in the center of the basic shape 23 is used for feeding through the cable channel 12 of the cover 5.

For the pre-encapsulation, the components shown in FIG. 3 are placed in a casting mold and potted using pre-encapsulation material 26. The potting is preferably performed in an unpressurized manner and at low temperatures (for example, less than 100° C.).

Figure 4:
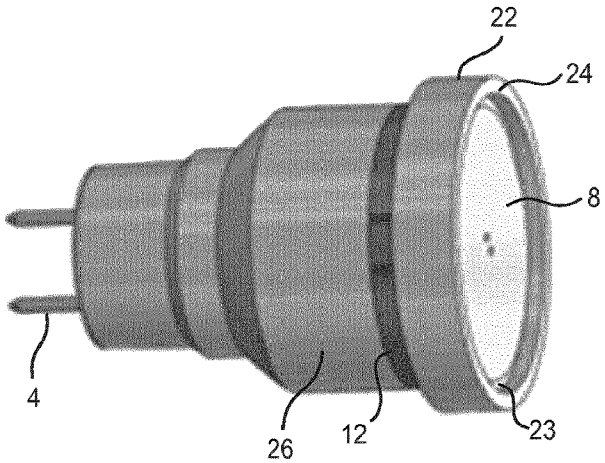
FIG. 4 shows a side view of the components from FIG. 3 in the pre-encapsulated state.

The components which are pre-encapsulated by the pre-encapsulation material 26 are shown in FIG. 4. They can be inserted into the driver housing 3 fitting up to the cover 5.

The pre-encapsulation material 26 may be molded in the region thereof to be inserted into the driver housing 3 in a manner fitting with the internal contour of the driver housing 3.

Figure 5:
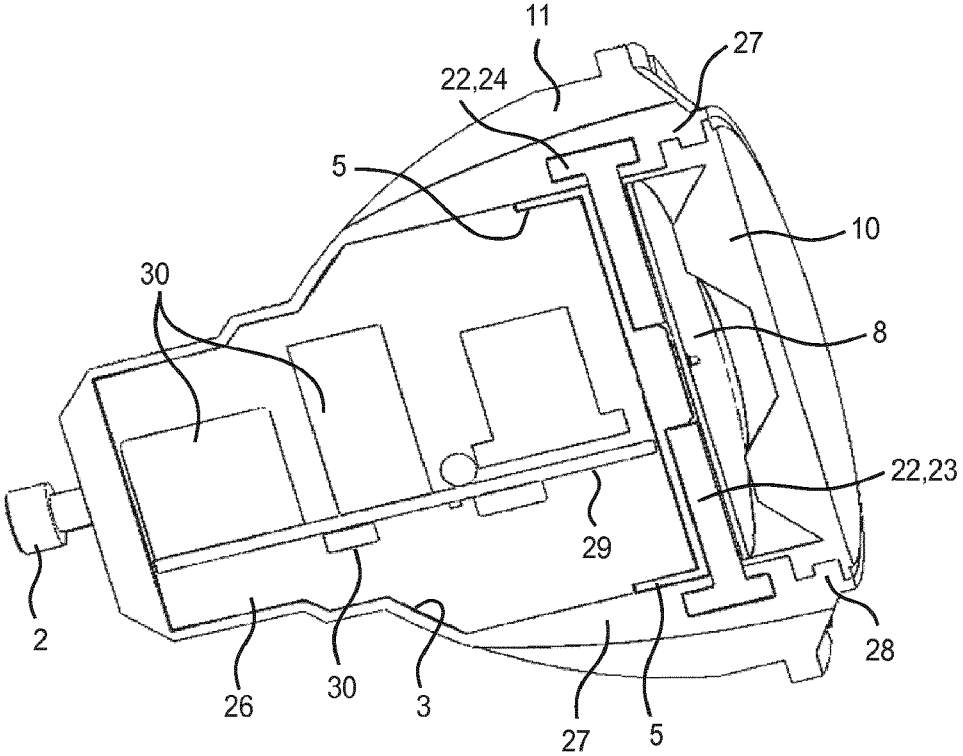
FIG. 5 shows the semiconductor lamp according to the second embodiment as a sectional illustration in a side view.

FIG. 5 shows the finished LED lamp 21 (without the LEDs 9) as a sectional illustration after the joint extrusion coating using the extrusion coating material 27. The outer edge 24 of the heat sink 22 is enclosed on the edge by the extrusion coating material 27 and is spaced apart from the second heat sink 11. However, because the distance is comparatively small, heat can also be transferred via the outer edge 24 of the first heat sink 22 to the second heat sink 11, which in turn dissipates heat to the surroundings, and also does so from the driver housing 3.

Since the pre-encapsulation material 26 presses closely against the driver housing 3, the heat transfer thereof to the driver housing 3 is comparable to a heat transfer of a driver which is potted or encapsulated in the driver housing 3. The driver is shown here with its printed circuit board 29 and various electrical and/or electronic components 30 arranged thereon.

The cover 5 (and therefore also the other pre-encapsulated components) is connected to the driver housing 3 by the joint extrusion coating with the extrusion coating material 27. The lens 10 is also thus permanently held in relation to the substrate 8. The lens 10 may have an undercut in the form of an exterior circumferential groove 28 for this purpose, for example.

In general, "a/an," "one," etc., can be understood as a single one or a plurality, in particular in the meaning of "at least one" or "one or more," etc., as long as this is not explicitly excluded, for example, by the expression "precisely one," etc.

A numeric specification can also include precisely the specified number and also a typical tolerance range, as long as it is not explicitly excluded.

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

What is claimed is:

1. A semiconductor lamp comprising:
a housing;
a housing cover configured to cover an open end of the housing;
a semiconductor light source comprising:
a substrate; and
at least one light-emitting diode (LED) populated on the substrate; and
a driver disposed within the housing and configured to drive the semiconductor light source;
wherein at least the housing and the housing cover are physically connected to one another via a joint extrusion coating material.

2. The semiconductor lamp of claim 1, wherein at least the housing, the housing cover, and the driver are physically connected to one another via the joint extrusion coating material.

3. The semiconductor lamp of claim 1, wherein the driver is fixed within the housing via a potting material.

4. The semiconductor lamp of claim 1, wherein the driver is a pre-encapsulated driver in that at least a portion thereof is at least partially encapsulated in a potting material prior to disposing the driver within the housing.

5. The semiconductor lamp of claim 4, wherein the driver and at least one of the following components of the semiconductor lamp together constitute a pre-encapsulated assembly in that they are at least partially encapsulated in the potting material prior to disposing the pre-encapsulated assembly within the housing:
the housing cover;
at least one heat sink of the semiconductor lamp; and
at least one terminal contact of the semiconductor lamp.

6. The semiconductor lamp of claim 5, wherein the pre-encapsulated assembly includes each of the driver, the housing cover, the at least one heat sink, and the at least one terminal contact.

7. The semiconductor lamp of claim 1, further comprising at least one of:
a first heat sink; and
a second heat sink.

8. The semiconductor lamp of claim 7, wherein at least the housing, the housing cover, and the first heat sink are physically connected to one another via the joint extrusion coating material.

9. The semiconductor lamp of claim 7, wherein at least the housing, the housing cover, the first heat sink, and the second heat sink are physically connected to one another via the joint extrusion coating material.

10. The semiconductor lamp of claim 7, wherein the first heat sink is of ring disk shape having an outer edge enclosed by the joint extrusion coating material.

11. The semiconductor lamp of claim 7, wherein the second heat sink is configured to be disposed over the housing cover and laterally enclose at least a portion of the housing.

12. The semiconductor lamp of claim 1, further comprising a light-transmissive cover.

13. The semiconductor lamp of claim 12, wherein at least the housing, the housing cover, and the light-transmissive cover are physically connected to one another via the joint extrusion coating material.

14. The semiconductor lamp of claim 12, wherein the light-transmissive cover has an exterior circumferential groove configured to receive the joint extrusion coating material such that the light-transmissive cover is held in spatial relation to the semiconductor light source.

15. A semiconductor lamp comprising:
a semiconductor light source comprising:
a substrate; and
at least one light-emitting diode (LED) populated on the substrate;
a driver configured to drive the semiconductor light source, wherein the driver is at least partially encapsulated in a potting material such that the potting material provides an exterior of the semiconductor lamp; and
a cover disposed between the semiconductor light source and the driver and configured to cover an end of the driver;
wherein the driver and the cover are physically connected to one another via a joint extrusion coating material.

16. The semiconductor lamp of claim 15, further comprising a heat sink physically supported by at least the driver.

17. The semiconductor lamp of claim 16, wherein at least the driver, the cover, and the heat sink are physically connected to one another via the joint extrusion coating material.

18. The semiconductor lamp of claim 15, further comprising a light-transmissive cover.

19. The semiconductor lamp of claim 18, wherein at least the driver, the cover, and the light-transmissive cover are physically connected to one another via the joint extrusion coating material.

20. The semiconductor lamp of claim 18, wherein the light-transmissive cover has an exterior circumferential groove configured to receive the joint extrusion coating material such that the light-transmissive cover is held in spatial relation to the semiconductor light source.

* * * * *